United States Patent [19]

Erickson et al.

[11] 4,020,432

[45] Apr. 26, 1977

[54] MOTORIZED SHUNT TRIP SWITCH OPERATOR

[75] Inventors: John W. Erickson; James A. Erickson, both of Crystal Lake, Ill.

[73] Assignee: Boltswitch, Inc., Crystal Lake, Ill.

[22] Filed: Aug. 25, 1975

[21] Appl. No.: 607,352

[52] U.S. Cl. ..... 335/76; 200/153 SC; 335/73

[51] Int. Cl.[2] ..... H01H 3/26; H01H 3/28

[58] Field of Search ..... 335/68, 69, 70, 71, 335/72, 73, 74, 75, 76, 77; 200/48 A, 153 SC; 318/457, 462

[56] References Cited

UNITED STATES PATENTS

| | | | |
|---|---|---|---|
| 3,198,906 | 8/1965 | Frink et al. | 335/73 |
| 3,234,803 | 2/1966 | Caswell et al. | 335/76 |
| 3,251,963 | 5/1966 | Date | 335/76 |
| 3,549,843 | 12/1970 | Wilson | 335/73 |

*Primary Examiner*—Harold Broome

*Attorney, Agent, or Firm*—Kinzer, Plyer, Dorn & McEachran

[57] ABSTRACT

A motor assembly for the switch operator mechanism of a high-current low-voltage bolted-pressure load-break switch; the switch operator mechanism includes spring drive means for rapidly driving the movable contact of the switch to its closed and opened positions, a main drive shaft, a drive linkage between the main drive shaft and the spring drive means, and trip means for actuating the spring drive means to open the switch. The motor assembly includes an electric motor, an operating shaft and a first transmission means including a mutilated ratchet element drivingly connecting the motor to the operating shaft. A second transmission means couples the operating shaft to the main drive shaft of the switch-operating mechanism for closing the switch. An electrical circuit is provided for automatically de-energizing the motor during switch closure.

4 Claims, 7 Drawing Figures

MOTORIZED SHUNT TRIP SWITCH OPERATOR

BACKGROUND OF THE INVENTION

This invention relates to a new and improved motorized shunt trip operator for a bolted pressure contact switch, and particularly to an improved electrical motor assembly for actuating the switch.

Fused load-break switches are frequently used as service entrance equipment and in other relatively high current applications. Typically, multiple-pole switches of this kind may be required to interrupt currents of 400 to 20,000 amperes. It is critcally important that the contacts of these switches open and close raplidly to minimize arcing and thereby avoid pitting and deterioration of the switch contacts. Most switches of this kind are provided with a latching mechanism for each pole of the switch to secure the contacts in closed position and prevent any accidental opening of the switch due to external shocks or other factors. The switch blades are relatively heavy and the mechanical forces involved in opening and closing operations are often substantial.

In many applications, load-break switches must include provision for opening and closing of the switches from remote locations. The usual solution of this problem has been the provision of motor-operated switch mechanisms. Gear motors are often employed for this purpose but are slow in operation and delay contact separation by one-half second or more after the initial fault signal. In comparison, a spring-operated switch may effect contact separation in about 1/10 second.

A motor employed directly to load the springs of a spring-operated switch mechanism would have to be quite large to provide the force necessary for rapid switch operation. Such a motor would add to the overall weight as well as the expense of a given switch installation. In addition, a separate reset cycle may have to be initiated after each actuation of the motor in order to position the operating parts of the motor assembly for subsequent actuation to open or close the switch.

Several other problems may be encountered in the operation of heavy-duty switches, particularly where remote actuation is required. If the switches are constructed for manual as well as motor operation, there is a risk of injury to any personnel near the switches if the handle for manual operation is interlocked to the motor drive. Such construction may well be found where a motor assist is provided for only the opening or only the closing operation, with the other being accomplished manually. But even regardless of safety, the force necessary for manual operation of large switches of this type may make it quite difficult if not impossible for certain individuals to operate the switch. Those persons unfamiliar with such a switch, which may be concealed within a protective housing, will have further difficulty if the handle position is not readily indicative of the condition of the switch, i.e., whether it is open or closed. Similarly, even when the protective housing is opened, the switch contacts are generally concealed behind an opaque barrier or shield which thereby deprives the operator of the most obvious indication of the condition of the switch.

SUMMARY OF THE INVENTION

It is an object of the present invention, therefore, to provide a new and improved motorized shunt trip operator for a load-break pressure-contact switch that is readily adaptable to remote actuation for both opening and closing of the switch.

A further object of the invention is to provide a new and improved motorized shunt trip operator which affords a substantial mechanical advantage so that a relatively small electric motor may be installed as the source of power for charging the spring drive means of the switch operator.

Another object of the present invention is to provide a new and improved motorized shunt trip operator which is automatically reset for subsequent actuations after each use.

A related object of the invention is a new and improved motorized shunt trip operator which automatically opens and closes a switch in response to respective single actuations of electrical control means.

A further object of the present invention is to provide a motorized shunt trip operator which requires no external operating handle which could cause injury in the case of remote operation.

A related object of the invention is a new and improved motorized shunt trip operator which, while eliminating the conventional handle, provides visual access to the switch contacts themselves for determining the condition of the switch.

Accordingly, the invention relates to a motorized shunt trip operating mechanism for a load break switch of the kind comprising a fixed contact and a movable contact movable between a closed position in bolted pressure contact with the fixed contact and an open position displaced from the fixed contact. The switch-operator mechanism for opening and closing the switch comprises spring drive means for rapidly driving the movable contact to its closed position and to its open position. A main drive shaft is connected by a drive linkage to the spring drive means to actuate the same to close the switch in response to rotation of the main drive shaft through a given arcuate distance in a predetermined direction. Trip means are provided for actuating the spring drive means to open the switch. The improvement comprises a motor assembly having an electric motor drivingly connected to an operating shaft by a first transmission means. The first transmission means includes a mutilated ratched element operatively connected to the operating shaft, which ratchet element defines a disengaged condition for the first transmission means at a first angular orientation of the ratchet element. In addition, second transmission means couples the operating shaft to the main drive shaft of the switch operator to rotate the main drive shaft in a direction to close the switch. To rotate the mutilated gear element beyond the first angular orientation, an electrically-actuated engagement device is provided. An electrical circuit is provided for energizing the motor and engagement device, which circuit include the sensing switch for de-energizing the motor and the engagement device at a second angular orientation of the ratchet element.

DESCRIPTION OF THE PREFERRED EMBODIMENT

Figure 1:
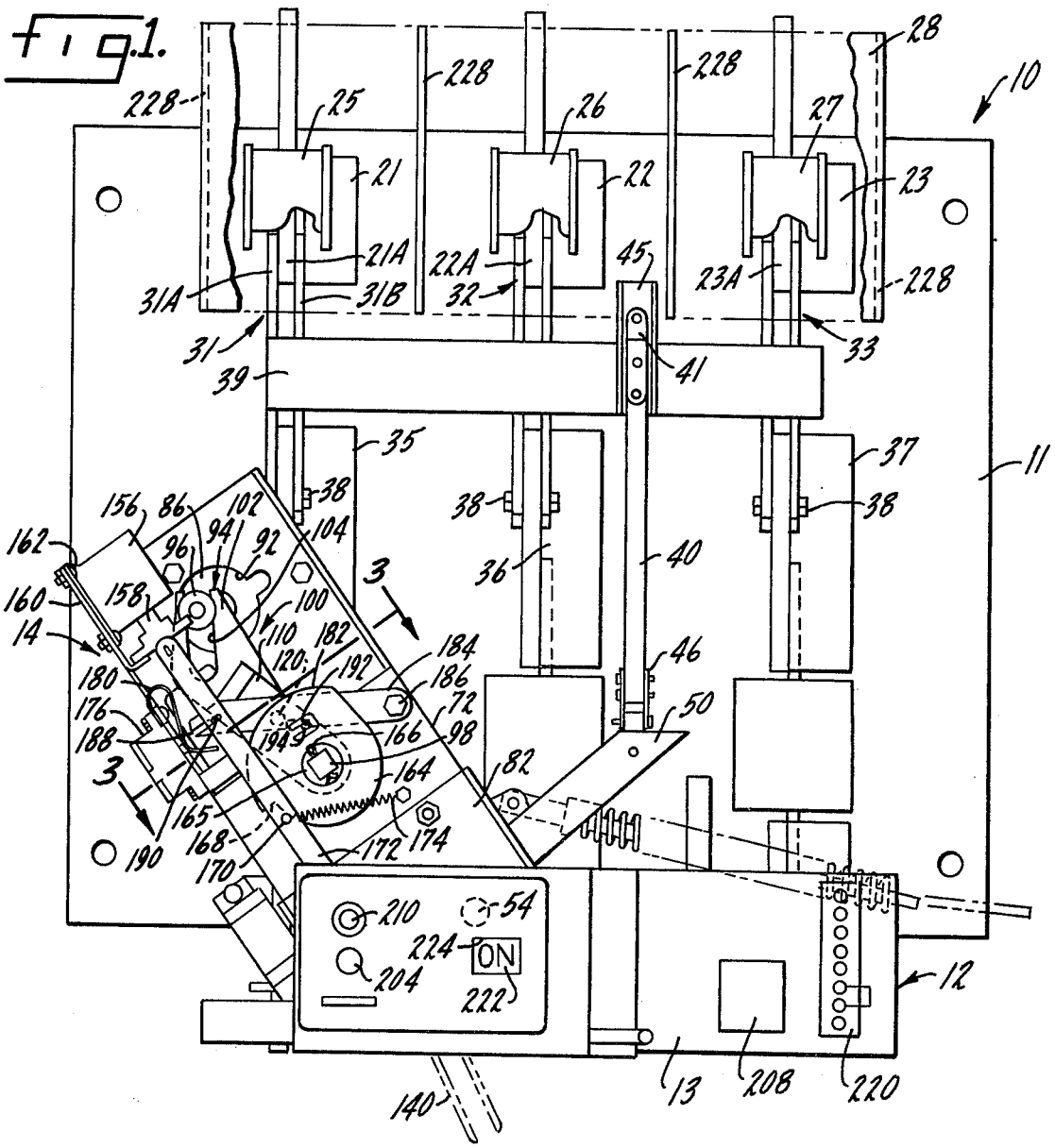
FIG. 1 is a front elevation view of a load-break switch equipped with a motorized shunt trip operator mechanism constructed in accordance with the present invention, the switch itself being of known constructon.
Figure 2:
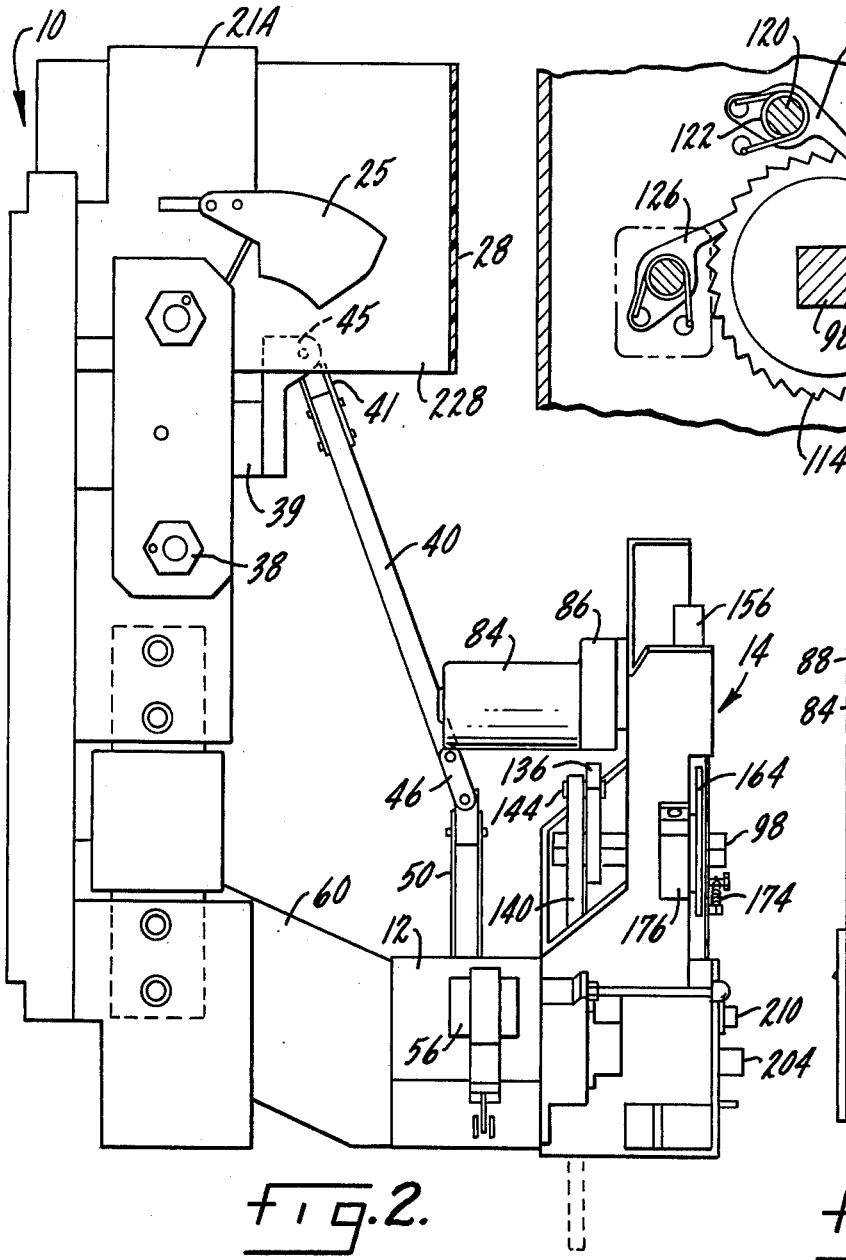
FIG. 2 is a side elevation view of the switch of FIG. 1.

FIGS. 1 and 2 illustrate a high-current low-voltage low-break switch 10, having a contact mechanism of known construction, in its closed condition. Switch 10 includes a base member 11 fabricated from a suitable insulating material. Switch 10 is operated by a trip-free operating mechanism 12 mounted in a housing 13 supported on base 11; mechanism 12 is in turn operated by a motor assembly 14 constructed in accordance with the present invention.

Across the top of base 11, there are mounted three fixed contacts 21, 22 and 23 provided with outwardly projecting contact blades 21A, 22A and 23A respectively; each fixed contact may be provided with an individual terminal lug (not shown). Three arc chutes 25, 26 and 27 are mounted on fixed contacts 21, 22 and 23, respectively. In addition, a shield 28 supported by suitable bracket means 228, extends across the front of the switch contacts.

Each of the fixed contacts 21-23 is one element of a pole for switch 10. Contacts 21, 22 and 23 are engageable by three movable contacts 31, 32 and 33 respectively. Each movable contact comprises a pair of contact blades such as the blades 31A and 31B of movable contact 31. Movable contacts 31, 32 and 33 are pivotally mounted upon three electrical connector brackets 35, 36 and 37 respectively, by means of suitable pivot members such as the bolts 38.

Switch 10 further includes an actuating bar 39 that extends transversely of the switch and that is connected to each of the movable contacts 31–33 by means of a connecting linkage, so that pivotal movement of bar 39 with respect to the aligned pivot pins 38 drives the movable contacts of the switch to move pivotally into and out of engagement with the fixed contacts 21–23. Switch 10 is also provided with appropriate overload fuses and electrical connectors to afford a means to complete electrical connections to the movable switch contacts.

Switch 10, as thus far described, corresponds in construction to the load-break pressure-contact switch described and claimed in U.S. Pat. No. 3,213,247. The present invention is not directed to the switch structure per se, and should not be construed as limited to the particlar load switch of U.S. Pat. No. 3,213,247 which is merely illustrative of a number of different forms of switch in which the invention may be incorporated. Rather, the present invention pertains to the motor assembly 14 in coupled relationship with the operating mechanism 12 for operating the switch.

Likewise, operating mechanism 12 is shown and described as corresponding in construction to the trip-free switch-operating mechanism described and claimed in U.S. Pat. No. 3,582,595. Neither is the present invention directed to the switch-operator mechanism per se, and should not be construed as limited to the particular switch-operated mechanism of U.S. Pat. No. 3,582,595, which similarly is merely illustrative of a number of different forms of switch operator mechanism with which the present invention may be coupled.

The actuating bar 39 of switch 10 is connected to an operating rod 40 (FIGS. 1 and 2) by means of a pivotal connection 41. More specifically, rod 40 has its upper end affixed to an upper yoke 45 and its lower end secured to a lower yoke 46. Lower yoke 46 is pivotally connected to an operating lever 50 that is a part of switch-operated mechanism 12. In FIGS. 1 and 2, operating lever 50 is shown in its upper or closed-switch position. Opening of the switch is effected by lever 50, switch turns in a clockwise direction (FIG. 1) and pulls drive rod 40 downwardly to pivot actuating bar 39 outwardly and away from switch base 11. This pivotal movement of bar 39 simultaneously pivots the movable contacts 31–33 outwardly from the fixed contacts 21–23 and thus opens the switch.

The number of poles in the switch 10, as well as the size of the contact elements of the switch, may be varied for different applications. However, for all switches of this gneral kind, it is essential that the contacts separate rapidly and close rapidly in order to prevent excessive arcing, which would otherwise limit the contact life quite severely.

The internal construction of the particular switch-operating mechanism 12 shown is fully described in detail in U.S. Pat. No. 3,582,595. The basic function of the switch-operating mechanism is to apply the required force to rapidly open and close switch 10. As explained above, it is actually the upward and downward angular movement of operating lever 50 which effects the closing and opening, respectively, of switch 10.

Switch operator-mechanism 12 is fixed in positional relationship in front of switch 10 by means of bracket 60. As disclosed in U.S. Pat. No. 3,582,595, operating lever 50 is rotatably mounted about a main drive shaft 54 of the switch-operator mechanism 12.

In the embodiment shown therein, rotation of the main drive shaft rotates a cam which causes a pair of follower plates to engage operating lever 50 to raise and lower it. The switch-operator mechanism is provided with overcenter spring drive means connected to the cam follower plates which is effective to force the cam plates to rapidly engage and rotate operating lever 50 once rotation of the main drive shaft 54 in either the switch-opening or switch-closing direction is initiated to force the spring drive means past its center position. Initial rotation of the main drive shaft 54 in the switch-opening. direction is accomplished by a switch-opening energy-storage device or spring which is charged during the closing motion of the switch. Initial rotation of the main drive shaft 54 in the switch-closing direction is accommplished by rotation of a handle shaft which is connected to the main drive shaft by a first latch means to rotate the main drive shaft 54 and charge the switch-opening energy-storage device. Once the main drive shaft has been rotated beyond the center position of the overcenter spring drive means, the latter rapidly closes the switch. Subsequent rotation of the handle shaft continues to charge the energy-storage device until the shaft is latched by a second latch means which prevents rotation of the handle shaft in the opposite or reset direction. At this point, the mechanism may be actuated by trip means such as the solenoid 56 (FIG. 2) to open the switch. The solenoid 56 is effective to disengage the first latch means, thereby releasing the switch-opening spring to rotate the main drive shaft in the switch-opening direction beyond the center point of the overcenter spring drive means. The latter then rapidly forces the main drive shaft and, in turn, the operating lever 50, to rotate rapidly in the clockwise or switch-opening direction to open the switch.

Thus, it can be seen that in the particular embodiment shown, an electrical signal from a remote location may be effective to actuate the switch-operator trip means or solenoid 56 to initiate opening of the switch. But to close the switch, force must be applied to rotate the handle shaft in the switch-closing direction. The present invention is directed to a motor assembly for automatically rotating the handle shaft in the switch-closing direction, which motor assembly is effective, when actuated by a single electrical signal, to close the switch, charge the switch-opening energy-storage device, and reset itself for subsequent actuations.

Although the motor assembly of the present invention is shown in conjunction with the particular switch-operating mechanism of U.S. Pat. No. 3,582,595, it is not nor is it intended to be limited to use exclusively with that particular switch-operating mechanism. Rather, the motor assembly of the present invention may be coupled with any switch-operating mechanism which requires a shaft to be rotated to initiate either closing or opening of a load-break switch.

In the preferred embodiment shown, the motor assembly of the present invention is assembled on a generally rectangular housing 70 having a relatively short face plate 72 (FIG. 3), a taller intermediate plate 74, and a back plate 76, all connected by side members 78 and 80. Housing 70 is securely fastened to a bracket 82 (FIG. 1) such as by bolts through back plate 76 or any other suitable means. Bracket 82 is fixed in positional relationship relative to the front of the switch-operator mechanism so as to properly position the motor assembly relative thereto. The motor assembly is inclined approximately 45° from the vertical in its attached position in the preferred embodiment. The particular angle at which it is situated is not critical but rather is a matter of design choice to be determined in accordance with the length and desired position of the various linkage between the motor assembly and particular switch-operator mechanism used.

An electric motor 84 (FIGS. 2 and 5) is mounted on an upper porton of intermediate plate 74 with the motor extending rearwardly thereof. Electric motor 84 is part of an integral unit including a speed reduction gear box 86, which together are secured to intermediate plate 74 such as by bolts 88 or any other suitable means. Electric motor 84 is preferably a universal motor.

Figure 5:
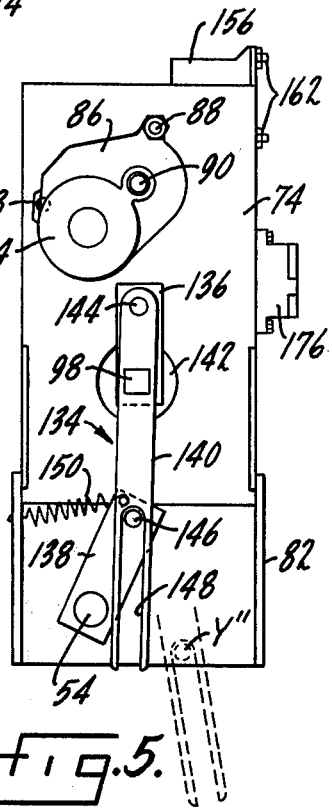
FIG. 5 is a rear elevation view of the motor assembly for the switch if FIG. 1.

Gear box 86 has an output shaft 90, seen from the rear in FIG. 5, which protrudes from the front of the gear box thrugh a generally circular opening 92 in the intermediate housing plate 74. A crank arm 94 (FIG. 1) is fixed onto the forward end of shaft 90 for rotation within the cutout portion 92 of intermediate wall 74. Crank arm 94 carries a pulley wheel 96 rotatably mounted at a point radially displaced from the axis of shaft 90.

Below the electric motor 84 (FIG. 1), an operating shaft 98 extends through the front and intermediate plates and rearwardly thereof toward back plate 76. Operating shaft 98 is drivingly connected to the electric motor 84 by a first transmission means referred to generally by reference character 100. The first transmission means 100 includes a yoke 102 rotatably mounted about operating shaft 98. The upper end of yoke 102 is provided with an open-ended slot 104 which is inclined at approximately 45° relative to the longitudinal axis of yoke 102, which intersects operating shaft 98. The edges of the yoke 102 which define slot 104 are slidingly fit over pulley wheel 96 and confined thereon by small peripheral flanges (not shown) on the pulley wheel 96 or other suitable means. It is advantageous to maintain the outer peripheral surface and inner bearing surface of pulley wheel 96 well lubricated to minimize friction between the yoke, pulley wheel and crank arm 94.

Rotation of pulley wheel 96 with crank arm 94 about shaft 90 causes yoke 102 to reciprocate through a limited arcuate path about operating shaft 98. While reciprocating yoke 102, it will be noted that pulley wheel 96 both rolls along one of the edges of slot 104 and axially traverses the slot in a reciprocal manner.

Figure 3:
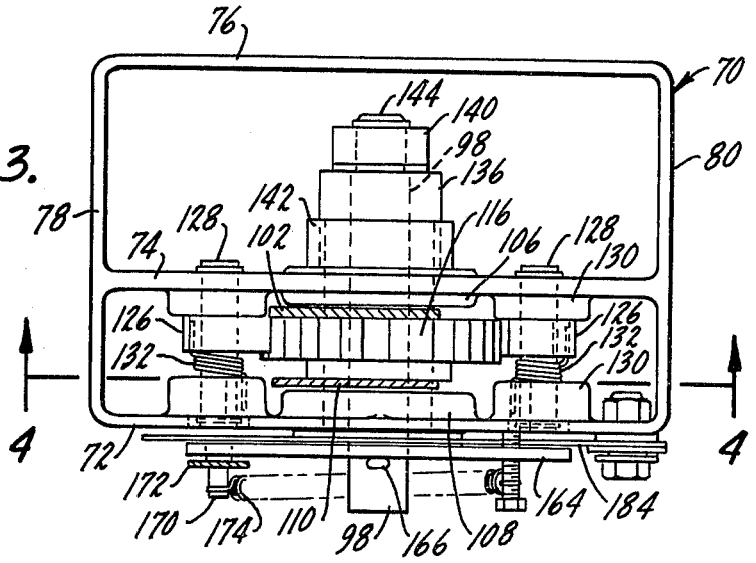
FIG. 3 is a section view of the motor assembly taken along line 3—3 in FIG. 1.

Referring to FIG. 3, it can be seen that yoke 102 is positioned adjacent an embossed center portion 106 of the intermediate plate 74. A similar embossed surface 108 is found on the back side of front plate 72. The embossed surfaces 106 and 108, which house the bearing means for supporting operating shaft 98 could be replaced, as by separate spacer plates, or eliminated altogether.

A generally inverted L-shaped secondary leg member 110 is rigidly connected to yoke 102 at one end and rotatably mounted about operating shaft 98 at the other. Yoke 102 and its secondary leg member 110 together thus form an inverted U-shaped member reciprocal about operating shaft 98 in response to rotation of crank arm 94 by motor 84.

A mutilated ratchet element 112 is rigidly mounted on operating shaft 98 for rotation therewith. Ratchet element 112 is axially positioned (FIG. 3) between yoke 102 and its secondary leg member 110. The peripheral surface of ratchet element 112 is provided with a plurality of uniformly spaced ratchet teeth 114, except that at least one of the teeth is missing, thereby exposing a smooth, arcuate peripheral surface area as at 116 (FIG. 4).

Figure 4:
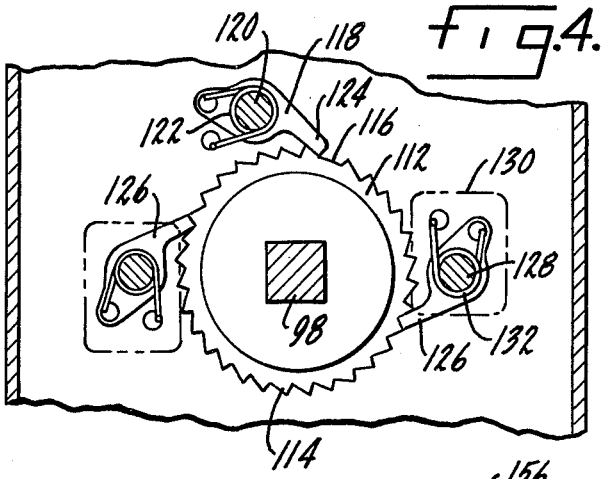
FIG. 4 is a fragmented section view taken approximately along line 4—4 in FIG. 3 showing the mutilated ratched element at its first angular orientation.

A drive pawl 118, shown in FIG. 4, is located above the ratchet wheel 112. Drive pawl 118 is rotatively mounted about a small axle 120 which spans the legs of yoke 102 at a position indicated in FIG. 1. Axle 120 may be axially positioned between the legs of yoke 102 with rotationaly freedom by a pair of snap rings (not shown) or it may be affixed to the legs, as by welding. The important point is that drive pawl 118 be able to pivot about axle 120. As shown in FIG. 4, a pawl spring 122 encircles axle 120 adjacent to drive pawl 118, with the end portions of the spring engaged with the drive pawl 118 and the yoke leg 110 respectively so as to urge the elongated tonque portion 124 of pawl 118 into engagement with teeth 114 of racthet wheel 112. Note that as drive pawl 118 reciprocates with yoke 102 about operating shaft 98 in response to each revolution of motor crank 94, it effectively drives ratchet wheel 112 one tooth position forward in the clockwise direction (FIG. 4) but slides over the ratchet wheel in its return or counterclockwise direction to engage the next tooth. Thus, oscillation of yoke 102 is converted into intermittent rotation of ratch element 112.

To prevent ratchet element 112 from backing up, or rotating in the counterclockwise direction (FIG. 4), a pair of back-up pawls 126 are mounted in operative relation to the mutilated ratchet element 112. As shown in FIG. 3, back-up pawls 126 are rotatively mounted on small axles 128 which are mounted embossed position 130 on the front and intermediate plates 72 and 74. Pawl springs 132 urge the back-up pawls 126 into engagement with the mutilated ratchet element 112.

In order to couple the operating shaft 98 of the motor assembly to the main drive shaft 54 of the switch-operator mechanism 12, for rotating the main drive shaft in a direction to close the switch, a second transmission means, referred to generally by reference character 134, is provided (FIG. 5). The second transmission means 134 comprises a first crank 136 fixedly mounted on the operating shaft 98 for rotation therewith, a second crank 138 affixed to the main drive shaft 54, and an elongated link member 140 coupling the crank 136 to the crank member 138 (FIG. 3). Rearwardly of intermediate plate 74, a spacer ring 142 is rotatively mounted about operating shaft 98 to axially space crank 136 from intermediate 74. Crank 136 is rigidly fixed to the end of operating shaft 98 such by welding or any other means which constrain the two for rotation in unison.

A rotating or free end of crank 136 carries a pin 144 (FIG. 5) on which one end of the link member 140 is rotatively mounted. Pin 144 may be fixed to crank 136 or linkage 140 or free to rotate relative to each of them so long as link 140 and crank 136 are rotatively coupled. Similarly, crank member 138 carries a pin 146 protruding rearwardly from its free end as shown in FIG. 5. Pin 146 is adopted to be slidingly received within an elongated slot 148 formed in one end of link member 140.

The operation of the second transmission means 134 is that of a crank rocker mechanism: rotation of the driver, crank 136, being effective to oscillate the follower, crank member 138. The operation of the second transmission means is most easily described in connection with the front view of the switch shown in FIG. 6. Crank 136 is rotatable through a complete arc of 360°, but only in the direction of arrow A. This is because the crank is fixed to operating shaft 98, which is prevented from rotating in a backward or counterclockwise direction by the back-up pawls 126 (FIG. 4) associated with ratchet element 112.

Figure 6:
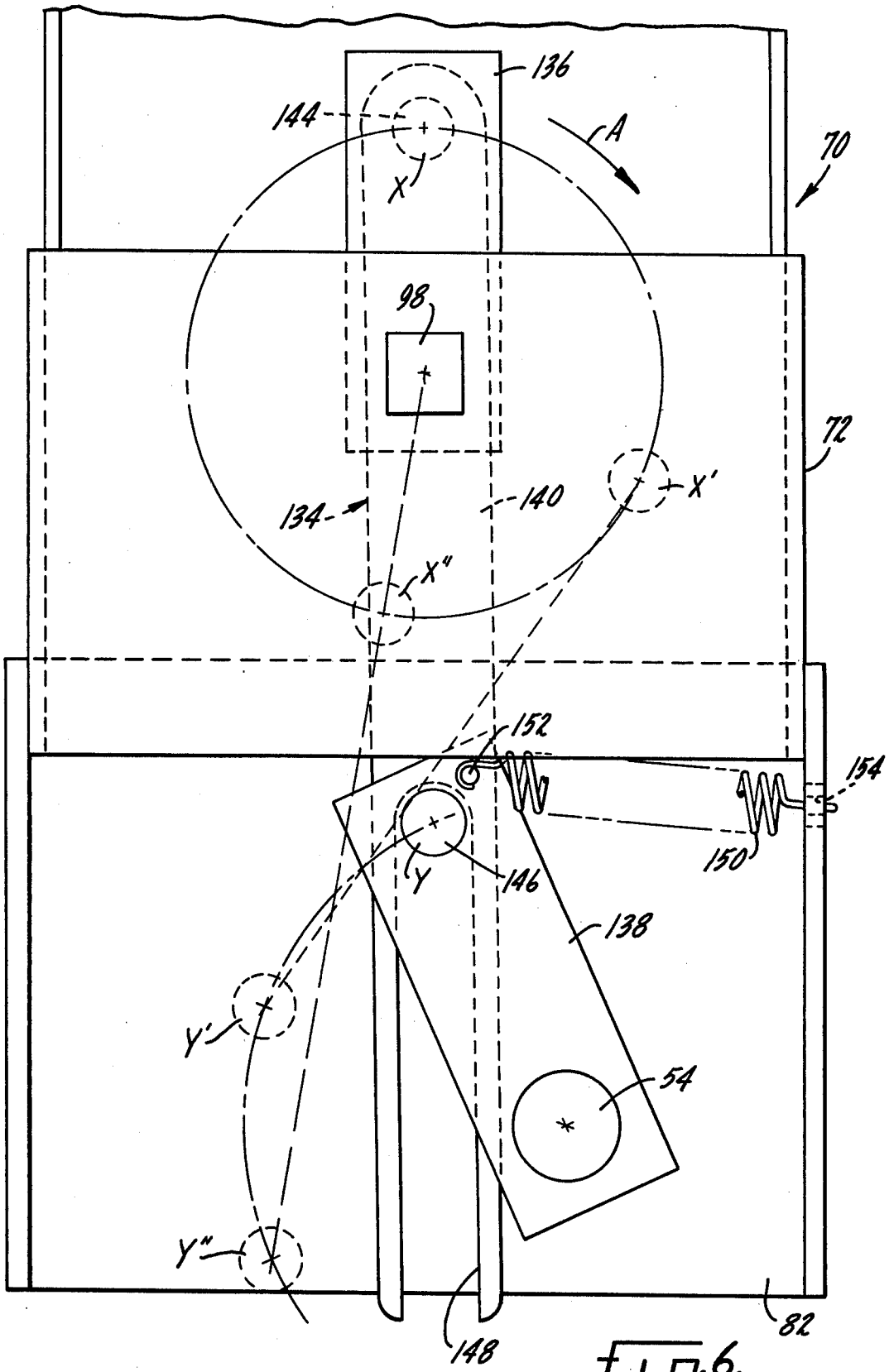
FIG. 6 is a front view showing the operative connection between the motor assembly and main drive shaft of the switch-operator mechanism.

Crank 136 is shown in FIG. 6 in that position which corresponds to the first angular orientation of the ratchet element, in which position the missing tooth portion 116 of ratchet wheel 112 is engaged by drive pawl 118, thus effecting a disengaged condition for the first transmission means.

The second crank member 138 is shown in its uppermost switch-open position, which position is maintained by the urging of a spring 150. Spring 150 is shown as a helical spring having hooked ends, one of which is engaged about a screw 152 inserted into the free end of crank member 138 and the other being engaged against the edge of a hole 154 in the side wall of bracket 82.

Accordingly, as crank 136 rotates in the direction of arrow A from its illustrated position (designed X) to an intermediate position (designated X′), the second crank 138 is driven by the link 140 from its illustrated position (designated Y) to an intermediate position (designated Y′). Continued rotation of crank 136 to position X″ forces crank 138 to its switch-closed position Y″. At this point, crank 136 and link 140 are aligned and fully extended from one another, thereby defining the full extent of travel of the second crank 138 as being from the switch-opened position (Y) to the switch-closed position (Y″). Further rotation of crank 136 towards its initial position X transmits no driving force to the second crank 138, since the crank 138 and its associated pin 146 are free to slide within slot 148 in link 140. Only the urging of spring 150 is effective to return the second crank 138 to its switch-open position Y. Thus, rotation of crank 136 from its initial position X through one complete revolution is effective to drive the second crank 138 through a limited arcuate distance from its switch-open position Y to its switch-closed position Y″ and then to allow the second crank 138 and shaft 54 to return freely to the switch-open position Y by the force of spring 150.

In order to initiate rotation of the mutilated ratchet element beyond its first angular orientation, an electrically-actuated engagement device is installed in accordance with the present invention. A starting solenoid 156 having an armature 158 is mounted on a bracket 160, as by screws 162. Bracket 160 is in turn rigidly connected to an upper flanged side of intermediate plate 74, as by welding or other suitable means. A ratchet starter mechanism couples armature 158 of solenoid 156 to the operating shaft 98 to transform linear motion of the armature into rotation of the operating shaft.

The ratchet starter mechanism includes a cam disc 164 (FIGS. 1 and 3) which is mounted on the operating shaft 98 in front of front plate 72. Cam disc 164 may be retained thereon by a washer 165 and a cotter key 166. The outer peripheral cam surface of disc 164 includes a shoulder 168 adapted to be engaged by an opposing shoulder or pin 170 fixed to a ratchet starter link 172. Ratchet starter link 172 is suspended from armature 158 of solenoid 156. The lower end of link 172, as shown in FIG. 1, is urged to the right by a spring 174 so that pin 170 is forced to follow the contour of cam disc 164.

Thus, upward translation of armature 158 in response to energization of solenoid 156 forces pin 170 against shoulder 168 of cam disc 154, causing the latter to rotate through at least one tooth position. Thereafter, drive pawl 118 (FIG. 4) engages one of the teeth 114 of ratchet wheel 112 and begins to close switch 10.

An electrical circuit (FIG. 7) is provided for energizing motor 84 and solenoid 156 of the motor assembly as well as solenoid 56 of the switch-operator mechanism. The circuit includes a sensing switch 176 (FIGS. 1 and 7) for de-energizing the motor 84 and solenoid 156 at a second angular orientation of the ratchet element 112. The sensing switch 176 is operated by a leaf spring 180; switch 176 and spring 180 are mounted on the flanged side of intermediate plate 74 below bracket 160. Spring 180 has a base portion which is engageable with switch 176 at one end and ratchet starter link 172 at the other. At rest, as in the position of FIG. 1, spring 180 is clear of link 172. But as rotation of ratchet element 112 is initiated, cam disc 164 is constrained to rotate therewith. As a raised portion or lobe 182 on cam disc 164 is rotated into engagement with pin 170, the link 172 is forced leftward (FIG. 1) thereby pressing spring 180 toward switch 176 to actuate the switch. The point of engagement of lobe 182 with pin 170 thus defines the second angular orientation of cam disc 164 and ratchet element 112, at which point sensing switch 176 is effective to de-energize motor 84. Rotation of ratchet element 112 is not immediately stopped; rather, motor 84 coasts to a stop, continuing to oscillate yoke 102 and rotate ratchet element 112 back to its first angular orientation. At that point, further oscillation of yoke 102 and drive pawl 118 is ineffective to continue to drive ratchet element 112, since drive pawl 118 engages the missing tooth portion 116 of ratchet element 112.

To assure that ratchet element 112 does not continue to rotate on its own momentum past its first angular orientation, a ratchet stop mechanism is provided. A ratchet stop member 184 is rotatably supported on front plate 72 between the front plate and cam disc 164. The right end is rotatably secured such as by bolts 186 laterally positioned from ratchet starter link 172 such that cam disc 164 is disposed therebetween. The other end of the ratchet stop 184 is provided with a slot 188 which slidingly engages a cotter key 190 which is fixed in position through an aperture in ratchet starter link 172. The ratchet stop 184 is so positioned relative to cam disc 164 that a shoulder 192 formed along the lower edge of the ratchet stop member is effective to engage an offset projection 194 formed in the interior of cam disc 164 when the cam disc is at its first angular orientation. Thus, abutment of projection 194 against shoulder 192 effectively prevents continued rotation of ratchet element 112 by its own inertia past its first angular orientation. Upon actuation of solenoid 156 to close switch 10, the slotted end of stop member 184 is pivoted upwardly with ratchet starter link 172, thereby disengaging shoulder 192 from projection 194 and permitting rotation of cam disc 164 and operating shaft 98.

A typical electrical operating circuit for the motor assembly and switch-operating mechanism described above is shown in FIG. 7. The circuit comprises two AC or DC power lines 200 and 202 connected to a suitable power supply, not shown. The shunt trip coil, solienoid 56, is connected between powerline 200 and one terminal of a "trip" pushbutton switch 204, the other terminal of switch 204 being connected through auxiliary switch 206 to powerline 202, thus completing the trip circuit. Connected in parallel with the trip circuit is a motor starter coil 208 having one terminal connected to line 200 through the motor cutoff switch 176 and two normally closed interlock switches 207 and 209. The other side of coil 208 is connected to one terminal of a "close" pushbutton switch 210 and to a pair of normally open motor starter relay contacts 212. The other side of switch 210 is connected through a normally closed auxiliary switch 214, ganged with switch 206, to power line 202. Solenoid 156 and motor 84 are connected in parallel between powerline 200 and a pair of normally open motor starter relay contacts 216 which, in turn, are connected to power line 202.

Figure 7:
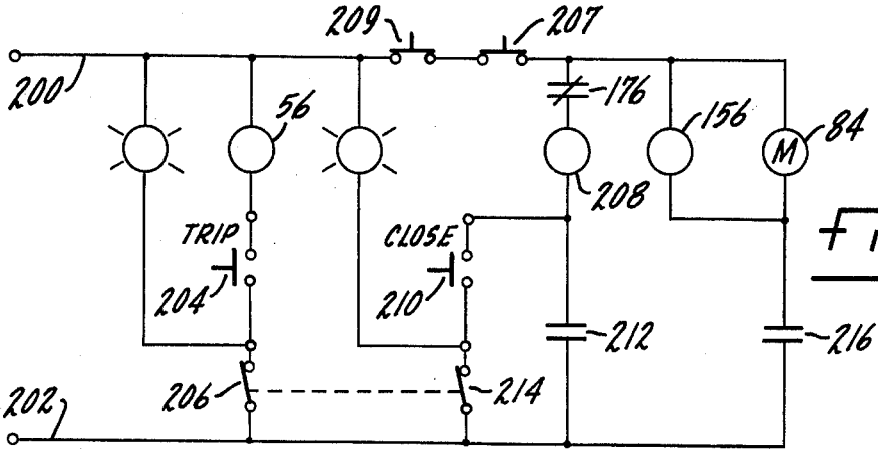
FIG. 7 is a schematic diagram of an electrical control circuit for the motorized shunt trip operator mechanism of FIG. 1.

The installed positions of the various electrical elements discussed in connection with FIG. 7 are shown best in FIG. 1. The "trip" and "close" switches 204 and 210 are prominently positioned on a front panel 218 which is positioned just in front of motor assembly 14 and fastened to the front plate 13 of the switch-operating mechanism 12. Motor starter 208 is mounted directly on the front plate 13 adjacent a terminal block 220 which provides for the various electrical connections shown in the circuit of FIG. 7. A target indicator disc 222 having ON and OFF labels may be keyed to the shaft of handle lever 138 so as to provide a visual indication of the switch condition. An opening 224 is cut out of front panel 13 at a position situated to expose the proper label of target indicator disc 222.

As a further visual indication of the switch condition, switch 10 is provided, in accordance with the present invention, with a transparent shield 28, as shown in FIGS. 1 and 2. Shield 28 is mounted across the front of the switch contacts by side shields or bracket 228. Not only does the shield protect an operator against electrical arcing or mechanical failure of the switch contacts, but it also affords him a direct view of the most reliable switch indicator of all, namely the actual position of the switch contacts. Although the motorized shunt trip operator of the present invention eliminates the need for the conventional handle and the dangers incident thereto, the operator who previously relied upon the handle position as an indicator of the switch condition can now view the contacts directly when the switch cabinet doors (not shown) are open. Conventional opaque shields afforded no such advantage.

In considering the operation of the motor assembly 14 in connection with switch 10, it is assumed that initially switch 10 is in its closed position as shown. Note that the various parts of the first and second transmission means of motor assembly 14 are all in those positions which correspond to the first angular orientation of ratchet element 112.

To open switch 10, the electrician closes the "trip" switch 204, thereby energizing the shunt trip coil, solenoid 56, which is effective to activate switch-operating mechanism 12. Operating lever 50 is rapidly forced downwardly, thereby pivoting actuating bar 39 and movable contacts 31–33 outwardly and away from fixed contacts 21–23. In the embodiment of the invention shown, using the switch operator mechanism of U.S. Pat. No. 3,582,595, lever 138 is latched in its switch-closed position Y″ prior to opening of the switch. Upon opening of the switch, lever 138 is released and free to pivot upwardly to its switch-open position Y by the urging of handle lever spring 150.

To close switch 10, the "close" switch 210 is closed to complete an energizing circuit (FIG. 7) for the motor starter coil 208, the circuit extending from power line 200 through interlock switches 207, 209, the normally closed motor cutoff switch 176, coil 208, switch 210 and auxiliary switch 214 to power line 202. Thus, contacts 212 and 216 close, establishing a holding circuit through contacts 212 for coil 208 that is independent of the release of the switch 210 by the electrician. Contacts 216, when closed, complete the operating circuits for motor 84 and starting solenoid 156.

Upon energization, solenoid 156 raises armature 158 (FIG. 1) which in turn drives pin 170 of the ratchet starter link 172 into shoulder 168 of cam disc 164. Simultaneously, ratchet stop 184 is lifted upwardly away from projection 194 on cam disc 164, thereby allowing the cam disc to rotate in response to the armature movement. Since cam disc 164 is affixed to operating shaft 98, on which ratchet element 112 is also secured, ratchet element 112 is rotated therewith through at least one tooth position, allowing drive pawl 118 to engage the first tooth 114 of ratchet element 112. Motor 84 operates continuously upon energization, driving the speed reduction gear box 86 to rotate crank arm 94 and pulley wheel 96. Rotation of crank arm 94 imparts an oscillating movement to yoke 102 and drive pawl 118, thereby rotating ratchet element 112 tooth by tooth in its switch-closed direction.

Crank 136, which is also fixed for rotation with operating shaft 98, is thus rotated from its switch-open position X (FIG. 6) is the direction of arrow A to its switch-closed position X''. Rotation of crank 136 is transmitted through forked link 140 to the second crank 138 of mechanism 12, forcefully driving it from its switch-open position Y toward its switch-closed position Y''. As crank 136 attains its switch-closed position Y'', lobe 182 of cam disc 164 bears against pin 170, thereby pushing ratchet starter link 172 into engagement with leaf spring 180 (FIG. 1), which, in turn, actuates the motor cutoff switch 176 and de-energizes motor 84 (FIG. 7). Motor coasts to a stop, continuing to rotate ratchet element 112 back to its first angular orientation at which drive pawl 118 engages the missing tooth portion 116 of the ratchet element. At this point, projection 194, cam disc 164, rotates into abutment with shoulder 192 of ratchet stop 184, thereby assuring that the various operating parts come to rest at their initial switch-closed positions shown in FIG. 1.

In the illustrated mechanism, using the switch-operating mechanism 12 of U.S. Pat. No. 3,582,595, rotation of crank 138 from its initial position Y to its switch-closed position Y'' is effective to force the spring drive means of mechanism 12 over center, thereby allowing the spring drive means to close the switch rapidly and forcefully. The second crank 138 is then latched in its switch-closed position. Thus, the complete switch opening and closing operations are complete with the various operating parts of the motor assembly and switch-operating mechanism all returned to their switch-closed positions.

Link 140 is an important element in the connecting linkage between the motor assembly and switch-operating mechanism. Because link 140 is slotted as at 148, crank 136 is drivingly connected to crank 138 only through that portion of its rotation which is required to drive crank 138 to its switch-closed position Y''. Thereafter, the pin and slot type connection between crank 138 and link 140 allows crank 136 to complete its rotation while crank 138 remains latched in its switch-closed position. Furthermore, in other embodiments wherein motor assembly 14 is coupled with different switch operator mechanisms, it may be found that the second crank 138 is forcefully rotated to its switch-open position upon opening of the switch by such other switch-operating mechanisms. Since pin 146 of crank 138 is free to slide upwardly within slot 148, the opening force of such a mechanism is not transmitted to the operating parts of motor assembly 14, which could otherwise cause a constant battering and damage to the operating parts of the motor assembly.

Whereas the preferred form of the invention has been described herein, it should be realized that there may be many modifications, substitutions, and alterations thereto, all within the spirit and broad scope of the appended claims.

We claim:

1. In a high-current low-voltage load break switch, of the kind comprising a fixed contact, a movable contact movable between a closed position in bolted pressure contact with the fixed contact and an open position displaced from the fixed contact, and a switch-operator mechanism for opening and closing the switch, the switch-operator mechanism including spring drive means for rapidly driving the movable contact to its closed position and to its open position, a main drive shaft rotationally reciprocable between a switch-closed position and a switch-open position, a drive connection between the main drive shaft and the spring drive means to actuate the spring drive means to close the switch in response to rotation of the main drive shaft through a given arcuate distance in a switch-closing direction toward its switch-closed position, and trip means for actuating the spring drive means to open the switch, a motor assembly for the switch operator mechanism comprising:

an electric motor;

an operating shaft;

first transmission means drivingly connecting the motor to the operating shaft to rotate the operating shaft in a given direction, the first transmission means including a mutilated ratchet element operatively connected to the operating shaft and defining a disengaged condition for the first transmission means at a first angular orientation of the ratchet element;

second transmission means, coupling the operating shaft to the main drive shaft of the switch operator, comprising a first crank member affixed to the operating shaft, a second crank member affixed to the main drive shaft, and a link member connected at its opposite ends to the first and second crank members to drive the second crank member and the main drive shaft in the switch-closing direction in response to rotation of the operating shaft in said given direction, the crank-link connection at one end of the link member permitting rotation of one crank member through a substantial arcuate distance without rotation of the other crank member;

an engagement device for rotating the mutilated ratchet element a limited distance in said given direction beyond said first angular orientation;

and an electrical circuit for energizing the motor, including a sensing switch for de-energizing the motor at a second angular orientation of the ratchet element.

2. A motor assembly for the switch operator of a load break switch, according to claim 1, in which said crank-link connection comprises a pin mounted on one of the connected members and engaging in an elongated slot in the other member.

3. A motor assembly for the switch operator of a load break switch, according to claim 2, in which the pin of the crank-link connection is mounted on the second crank member and the elongated slot is formed in the link member, permitting the first crank member to continue to rotate through a substantial arcuate distance after the second crank member and the main drive shaft have reached the switch-closed position.

4. A motor assembly for the switch operator of a load break switch, according to claim 1, in which said crank-link connection comprises a pin mounted on one of the connected members in engagement with an elongated linear guide surface on the other connected member, and in which the other end of the link member is pivotally connected to a fixed point on the remaining crank member.

* * * * *